US012768580B2

(12) United States Patent
Manohar et al.

(10) Patent No.: US 12,768,580 B2
(45) Date of Patent: Oct. 20, 2026

(54) REFRIGERANT LEAK MITIGATION USING ISOLATION VALVES

(71) Applicant: Lennox Industries Inc., Richardson, TX (US)

(72) Inventors: Shailesh Manohar, Coppell, TX (US); Eric Berg, The Colony, TX (US); Umesh Gokhale, Coppell, TX (US); Vijay Sathyamurthi, Frisco, TX (US); Daniel Diaz, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 100 days.

(21) Appl. No.: 18/768,607

(22) Filed: Jul. 10, 2024

(65) Prior Publication Data

US 2025/0035356 A1 Jan. 30, 2025

Related U.S. Application Data

(60) Provisional application No. 63/515,316, filed on Jul. 24, 2023.

(51) Int. Cl.
*F25B 49/02* (2006.01)

(52) U.S. Cl.
CPC .... *F25B 49/022* (2013.01); *F25B 2313/0312* (2013.01); *F25B 2400/19* (2013.01); *F25B 2500/222* (2013.01); *F25B 2600/0251* (2013.01); *F25B 2600/2519* (2013.01)

(58) Field of Classification Search
CPC ..... F25B 49/022; F25B 2313/0312; F25B 2400/19; F25B 2500/222; F25B 2600/0251; F25B 2600/2519
See application file for complete search history.

(56) References Cited

U.S. PATENT DOCUMENTS

2017/0138645 A1* 5/2017 Sakima ..... F25B 13/00
2020/0049361 A1* 2/2020 Minamida ..... F24F 11/36
2022/0082304 A1* 3/2022 Welch ..... F25B 49/022

* cited by examiner

*Primary Examiner* — Elizabeth J Martin
(74) *Attorney, Agent, or Firm* — Baker Botts L.L.P.

(57) ABSTRACT

A method for performing a pump down cycle to isolate an indoor section of a heating, ventilation, and air conditioning (HVAC) from an indoor section of the HVAC system is disclosed. The method includes transmitting a first control signal to a compressor of the HVAC system. The first control signal causes the compressor to turn on or stay turned on. The method further includes transmitting a second control signal to a vapor line isolation valve. The second control signal causes the vapor line isolation valve to open. The method further includes transmitting a third control signal to a liquid line isolation valve. The third control signal causes the liquid line isolation valve to close. The method further comprises determining that a refrigerant charge in the indoor section has become less than a threshold value. In response, the compressor is turned off and the vapor line isolation valve is closed.

20 Claims, 2 Drawing Sheets

REFRIGERANT LEAK MITIGATION USING ISOLATION VALVES

PRIORITY

This application claims priority to U.S. Provisional Patent Application No. 63/515,316 filed Jul. 24, 2023 and titled "Refrigerant leak mitigation using isolation valves," which is incorporated herein by reference.

TECHNICAL FIELD

This disclosure relates generally to heating, ventilation, and air conditioning (HVAC) systems. More particularly, this disclosure relates to refrigerant leak mitigation using isolation valves.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

Regulations in the heating, ventilation, and air conditioning (HVAC) industry are pushing manufacturers to transition away from traditional refrigerants towards low global warming potential (GWP) refrigerants, particularly mildly flammable (A2L) refrigerants. To accommodate the changes, manufacturers may need to design HVAC systems, including indoor coils, to be adjusted specifically to the A2L refrigerants (e.g., R-32 and/or R-454B). The adoption of A2L refrigerants poses several challenges due to their flammability. Unlike traditional refrigerants, A2L refrigerants require enhanced safety measures to mitigate risks associated with potential leaks. These measures include improved leak detection, advanced control systems, and robust containment strategies to ensure that the refrigerant concentration remains less than flammable limits within indoor environments. To comply with UL 60335-2-40 and similar standards, manufacturers implement rigorous design and testing protocols. This includes the placement of refrigerant sensors within the HVAC system to detect and respond to leaks. In one approach, leak detection sensors may be implemented in an HVAC system to detect refrigerant leaks. For example, one approach for limiting the concentration of refrigerant in the conditioned space is to use a leak detection sensor that can detect refrigerant in the airstream of the HVAC system.

This disclosure describes a system and method that are configured to mitigate refrigerant charges that are more than a predefined allowed threshold value without, in one embodiment, the need to implement leak detection sensors and mitigations associated with them. In some embodiments, the disclosed system is configured to isolate the indoor section of the HVAC system from the outdoor section of the HVAC system using isolation valves while the compressor is turned on to allow the refrigerant to flow out of the indoor section of the HVAC system. This leads to the refrigerant charge within the indoor section of the HVAC system being reduced and maintained at less than a regulatory threshold value.

In some embodiments, the disclosed system is configured to implement a vapor line isolation valve on a vapor line, a liquid line isolation valve on a liquid line, and optionally, a pressure relief valve in parallel to the vapor line isolation valve. The disclosed system is configured to implement a pump down cycle to facilitate that the refrigerant charge in the indoor section remains less than the regulatory threshold value. In some embodiments, the pump down cycle may be performed after a conditioning demand (e.g., at the end of a conditioning demand) and/or during an off-cycle period when no conditioning demand is present. During the pump down cycle, the compressor is turned on or remains turned on (after a conditioning demand), a vapor line isolation valve is opened, and a liquid line isolation valve is closed to allow the refrigerant to flow out of the indoor section and into the outdoor section of the HVAC system.

In this way, the disclosed system proactively manages the refrigerant charge within the indoor section to remain less than the regulatory threshold. This, in turn, leads to reducing the refrigerant charge and concentration in case of a refrigerant leak. Thus, the disclosed system is configured to proactively mitigate refrigerant excess charges and concentration without implementing leak detection sensors. The disclosed HVAC system offers technical advantages in that the refrigerant charge inside the indoor section of the HVAC system remains less than safety thresholds without requiring additional leak detection sensors. This operation is described in greater detail further than in conjunction with FIG. 2.

In some embodiments, the present disclosure provides a heating, ventilation, and air conditioning (HVAC) system configured to regulate a temperature of a space. The HVAC system comprises a vapor line isolation valve located in a vapor line of the HVAC system. The HVAC system further comprises a liquid line isolation valve located in a liquid line of the HVAC system. The HVAC system further comprises a compressor configured to move the refrigerant between an indoor heat exchanger and an outdoor heat exchanger. The HVAC system further comprises a controller communicatively coupled to the vapor line isolation valve and the liquid line isolation valve. The controller comprises a processor configured to perform a pump down cycle comprising the following operations. The processor is configured to transmit, to the compressor, a first signal that causes the compressor to be turned on or stay turned on to transfer at least a portion of the refrigerant from the indoor heat exchanger to the outdoor heat exchanger to reduce a refrigerant charge in an indoor section of the HVAC system. The processor is further configured to transmit, to the vapor line isolation valve, a second signal that causes the vapor line isolation valve to open. The processor is further configured to transmit, to the liquid line isolation valve, a third signal that causes the liquid line isolation valve to close. The processor is further configured to determine that the refrigerant charge in the indoor section of the HVAC system has decreased to be less than a threshold value. The processor is further configured to turn off the compressor in response to determining that the refrigerant charge in the indoor section of the HVAC system has decreased to be less than the threshold value.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
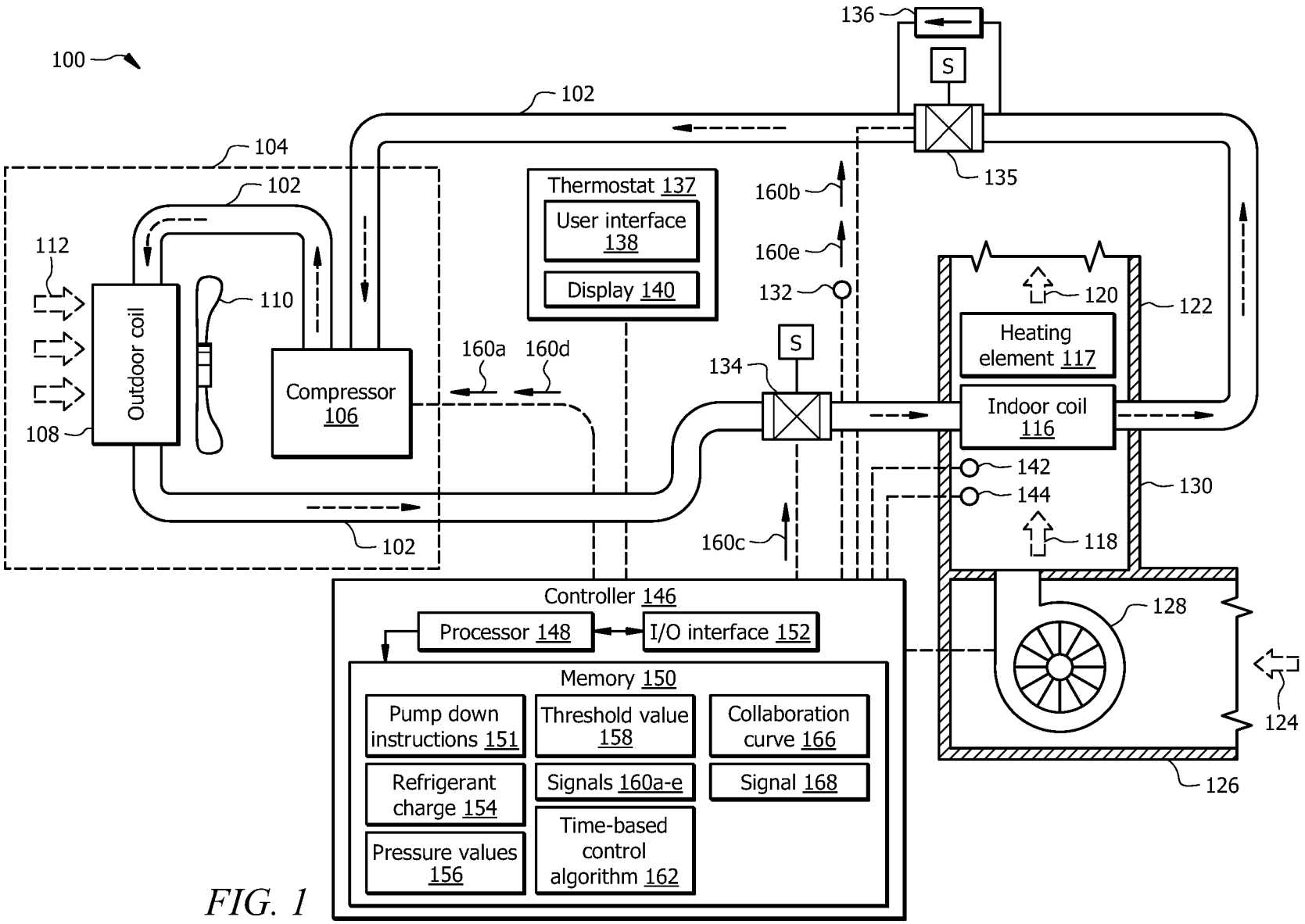
FIG. 1 illustrates a diagram of an embodiment of an HVAC system configured to mitigate refrigerant leaks according to some embodiments of the present disclosure.
Figure 2:
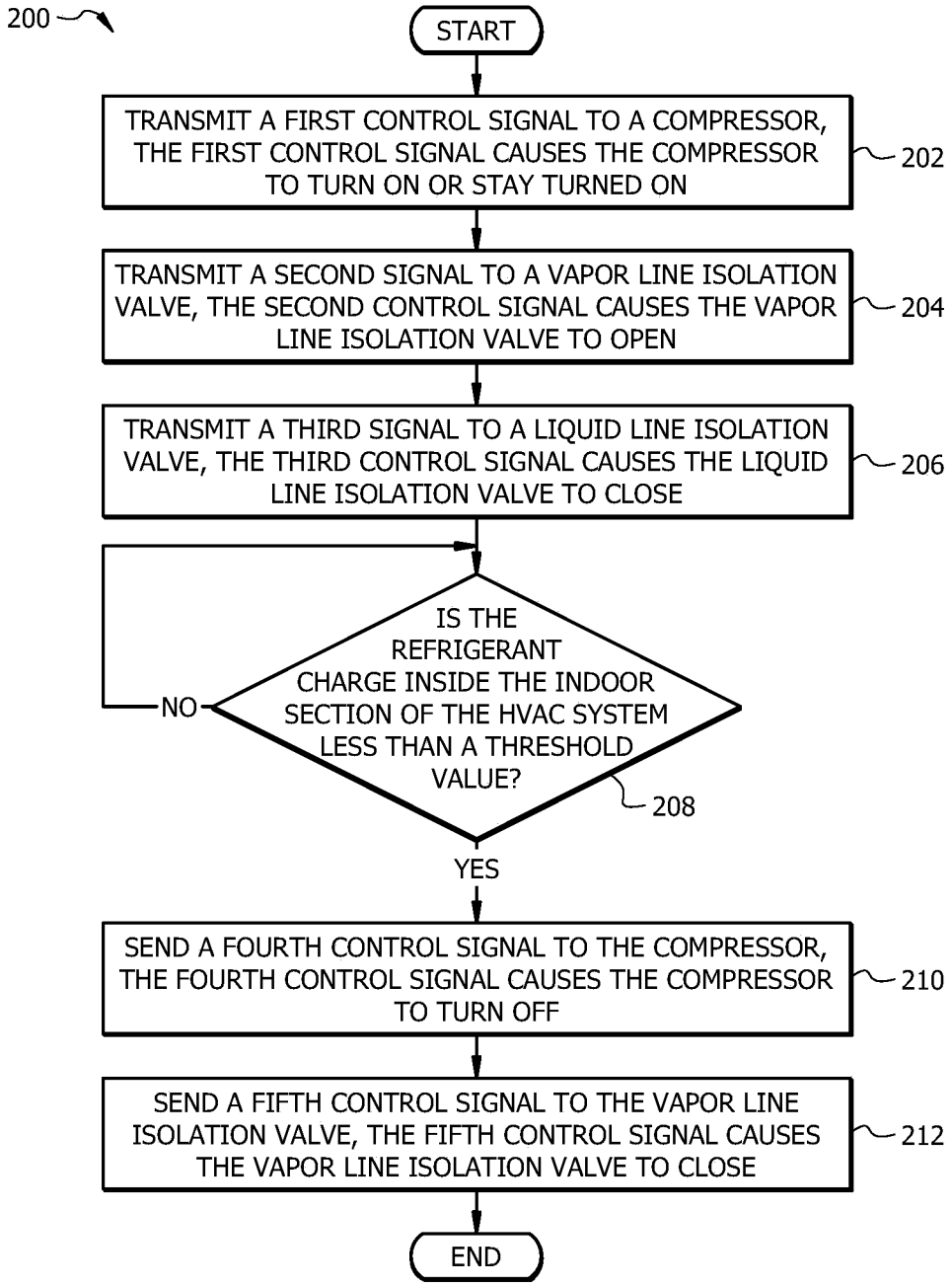
FIG. 2 illustrates a flowchart of an example method of operating the system of FIG. 1.

Embodiments of the present disclosure and its advantages are best understood by referring to FIGS. 1 through 2 of the drawings, like numerals being used for like and corresponding parts of the various drawings.

Regulations in the heating, ventilation, and air conditioning (HVAC) industry are pushing manufacturers to transition away from traditional refrigerants towards low global warming potential (GWP) refrigerants, particularly mildly flammable (A2L) refrigerants. To accommodate the changes, manufacturers may need to design HVAC systems, including indoor coils, to be adjusted specifically to the A2L refrigerants (e.g., R-32 and/or R-454B). The adoption of A2L refrigerants poses several challenges due to their flammability. Unlike traditional refrigerants, A2L refrigerants require enhanced safety measures to mitigate risks associated with potential leaks. These measures include improved leak detection, advanced control systems, and robust containment strategies to ensure that the refrigerant concentration remains less than flammable limits within indoor environments. To comply with UL 60335-2-40 and similar standards, manufacturers implement rigorous design and testing protocols. This includes the placement of refrigerant sensors within the HVAC system to detect and respond to leaks. In one approach, leak detection sensors may be implemented in an HVAC system to detect refrigerant leaks. For example, one approach for limiting the concentration of refrigerant in the conditioned space is to use a leak detection sensor that can detect refrigerant in the airstream of the HVAC system.

This disclosure describes a system and method that are configured to mitigate refrigerant charges that are more than a predefined allowed threshold value without, in one embodiment, the need to implement leak detection sensors and mitigations associated with them. In some embodiments, the disclosed system is configured to isolate the indoor section of the HVAC system from the outdoor section of the HVAC system using isolation valves while the compressor is turned on to allow the refrigerant to flow out of the indoor section of the HVAC system. This leads to the refrigerant charge within the indoor section of the HVAC system being reduced and maintained at less than a regulatory threshold value.

In some embodiments, the disclosed system is configured to implement a vapor line isolation valve on a vapor line, a liquid line isolation valve on a liquid line, and optionally, a pressure relief valve in parallel to the vapor line isolation valve. The disclosed system is configured to implement a pump down cycle to facilitate that the refrigerant charge in the indoor section remains less than the regulatory threshold value. In some embodiments, the pump down cycle may be performed after a conditioning demand (e.g., at the end of a conditioning demand) and/or during an off-cycle period when no conditioning demand is present (e.g., between the conditioning demands). During the pump down cycle, the compressor is turned on or remains turned on (after a conditioning demand), a vapor line isolation valve is opened, and a liquid line isolation valve is closed to allow the refrigerant to flow out of the indoor section and into the outdoor section of the HVAC system.

In this way, the disclosed system proactively manages the refrigerant charge within the indoor section to remain less than the regulatory threshold. This, in turn, leads to reducing the refrigerant charge and concentration in case of a refrigerant leak. Thus, the disclosed system is configured to proactively mitigate refrigerant excess charges and concentration without implementing leak detection sensors. The disclosed HVAC system offers technical advantages in that the refrigerant charge inside the indoor section of the HVAC system remains less than safety thresholds without requiring additional leak detection sensors. This operation is described in greater detail further than in conjunction with FIG. 2.

HVAC System

FIG. 1 illustrates an example HVAC system 100 according to an embodiment of the present disclosure. The HVAC system 100 conditions air for delivery to a conditioned space (e.g., all or a portion of a room, a house, an office building, a warehouse, or the like). In some embodiments, the HVAC system 100 is a rooftop unit (RTU) that is positioned on the roof of a building, and the conditioned air is delivered into the interior of the building. In other embodiments, portion(s) of the system 100 may be located within the building and portion(s) outside the building. The HVAC system 100 may be configured as shown in FIG. 1 or in any other suitable configuration. For example, the HVAC system 100 may include additional components or may omit one or more components shown in FIG. 1.

The HVAC system 100 includes a working fluid conduit 102, at least one condensing unit 104, an indoor coil 116, a heating element 117, a blower 128, a room temperature sensor 132, one or more liquid line isolation valves 134, one or more vapor line isolation valves 135, a pressure relief valve 136, one or more thermostats 137, a pressure sensor 142, a pressure switch 144, and a controller 146. The controller 146 is generally configured to operate the other components of the HVAC system 100, detect refrigerant charge 154 within the indoor section of the HVAC system 100 using the pressure sensor 142 and/or pressure switch 144, and/or time-based control algorithm 162, and execute the pump down instructions 151, among other operations as described herein.

In some embodiments, when the refrigerant charge 154 has reached a threshold value 158, the controller 146 initiates the HVAC system 100 to operate in a mitigation mode, e.g., by executing the pump down instructions 151 to perform the pump down cycle where the compressor 106 is turned on or remained turned on, the one or more liquid line isolation valves 134 are closed, and one or more vapor line isolation valves 135 are open for a duration of time to reduce the refrigerant charge 154 within the indoor section of the HVAC system 100 until the refrigerant charge 154 is less than the threshold value 158. The threshold value 158 may be any value less than the regulatory threshold value according to applicable safety standards. For example, the threshold value may be less than ×⅙ of the LFL (kg) regulatory threshold value according to applicable safety standards. In response to determining that the refrigerant charge 154 is less than the threshold value 158, the compressor 106 may be turned off. The vapor line isolation valve 135 may be closed at the end of the pump down cycle.

The working fluid conduit 102 facilitates the movement of a working fluid (e.g., one or more refrigerants) through a cooling cycle such that the working fluid flows as illustrated by the dashed arrows in FIG. 1. The working fluid may be any acceptable working fluid including, but not limited to, fluorocarbons (e.g., chlorofluorocarbons), ammonia, non-halogenated hydrocarbons (e.g., propane), or hydrofluorocarbons (e.g., R-410A). In some embodiments, the working fluid comprises a mildly flammable A2L refrigerant. As used herein, the term "mildly flammable A2L refrigerant" may be defined in one embodiment according to ASHRAE Standard 34. In one example, according to the ASHRAE Standard 34, the mildly flammable A2L refrigerant meets all four of the following conditions: (i) exhibits flame propagation when tested at 140° F. (60° C.) and 14.7 psia (101.3 kPa); (ii) has a lower flammability limit (LFL)>0.0062 lb/ft$^3$ (0.10 kg/m$^3$); (iii) has a heat of combustion<8169 Btu/lb (19,000 kJ/kg); and (iv) has a maximum burning velocity of ≤3.9 in/s (10 cm/s) when tested at 73.4° F. (23° C.) and 14.7 psia (101.3 kPa) in dry air. Suitable examples of mildly flammable A2L refrigerants include, but are not limited to, R-32, R-454b, or combinations thereof.

The condensing unit 104 comprises a compressor 106, an outdoor coil 108, and a fan 110. In some embodiments, the condensing unit 104 is an outdoor unit while other components of the HVAC system 100 may be located indoors. The compressor 106 is coupled to the working fluid conduit 102 and compresses (i.e., increases the pressure) of the working fluid. The compressor 106 is in signal communication with the controller 146 using wired and/or wireless connection. The controller 146 provides commands and/or signals to control the operation of the compressor 106 and/or receive signals from the compressor 106 corresponding to a status of the compressor 106. The compressor 106 of condensing unit 104 may be a single-speed, variable-speed, or multiple-stage compressor. A variable-speed compressor is generally configured to operate at different speeds to increase the pressure of the working fluid to keep the working fluid moving along the working-fluid conduit subsystem 102. In the variable-speed compressor configuration, the speed of compressor 106 can be modified to adjust the cooling capacity of the HVAC system 100. Meanwhile, in the multi-stage compressor configuration, one or more compressors can be turned on or off to adjust the cooling capacity of the HVAC system 100.

The outdoor coil 108 is configured to facilitate the movement of the working fluid through the working fluid conduit 102. The outdoor coil 108 is generally located downstream of the compressor 106 and is configured to remove heat from the working fluid. The fan 110 is configured to move air 112 across the outdoor coil 108. For example, the fan 110 may be configured to blow outside air through the outdoor coil 108 to help cool the working fluid flowing therethrough. The fan 110 may be in communication with the controller 146 (e.g., via wired and/or wireless communication) to receive control signals for turning the fan 110 on and off and/or adjusting the speed of the fan 110. The compressed, cooled working fluid flows from the outdoor coil 108 toward the liquid line isolation valve 134.

The indoor coil 116 is generally any heat exchanger configured to provide heat transfer between the air flowing through (or across) the indoor coil 116 (i.e., airflow 118 contacting an outer surface of one or more coils of the indoor coil 116) and working fluid passing through the interior of the indoor coil 116. The indoor coil 116 may include one or more circuits of coils. The indoor coil 116 is fluidically connected to the compressor 106, such that working fluid generally flows from the indoor coil 116 to the condensing unit 104 when the HVAC system 100 is operating to provide cooling. When the HVAC system 100 is configured to operate as a heat pump the indoor coil 116 acts as a condenser to heat the flow of air 120 passing therethrough. When the HVAC system 100 is configured to operate in a cooling mode, the indoor coil 116 acts as an evaporator to cool the flow of air 120 passing therethrough.

A portion of the HVAC system 100 is configured to move airflow 118 provided by the blower 128 across the indoor coil 116 and out of a duct system 122 as conditioned airflow 120. Return air 124, which may be air returning from the building, fresh air from outside, or some combination, is pulled into a return duct 126. A suction side of the blower 128 pulls the return air 124. The blower 128 discharges airflow 118 into a duct 130 such that airflow 118 crosses the indoor coil 116 or heating element 117 to produce conditioned airflow 120. The blower 128 is any mechanism for providing airflow 118 through the HVAC system 100. For example, the blower 128 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower.

The heating element 117 is generally any device for heating the flow of air 118 and providing heated air 120 to the conditioned space when the HVAC system 100 operates in a heating mode. For example, the heating element 117 may be a furnace. The heating element 117 may be configured to receive fuel from a fuel source, where the heating element 117 is configured to ignite the fuel to heat the heating element 117. Exemplary fuels include but are not limited to natural gas, propane, oil, or any other combustible compound. In some embodiments, the HVAC system 100 is configured to operate as a heat pump. Generally, when the HVAC system is operating as a heat pump in a heating mode, the flow of refrigerant is reversed, such that the outdoor coil 108 acts as an evaporator and the indoor coil 116 acts as a condenser to heat the flow of air 120 passing therethrough. If the HVAC system 100 is configured to operate as a heat pump, the HVAC system 100 may include a reversing valve to reverse the flow of working fluid through the HVAC system 100 during operation in the heating mode and an outdoor expansion device for expanding the working fluid provided to the outdoor coil 108, which acts an evaporator in the heating mode. When the HVAC system 100 is configured to operate as a heat pump, the heating element 117 may provide supplemental and/or backup heating to the flow of air 120. The heating element 117 may be in communication with the controller 146 (e.g., via wired and/or wireless communication) to receive control signals for activating the heating element 117 to heat the flow of air 118 when the HVAC system 100 is operated in a heating mode. Generally, when the HVAC system 100 is operated in a heating mode, the heating element 117 and blower 128 are turned on such that the flow of air 118 is provided across and heated by the heating element 117. When the HVAC system 100 is operated in a cooling mode, the heating element 117 is generally turned off (i.e., such that the flow of air 118 is not heated by heating element 117).

The room sensor 132 in signal communication with the controller 146 (e.g., via wired and/or wireless connection). Room sensor 132 is positioned and configured to measure an indoor air temperature. The room sensor 132 may also be configured to measure air humidity and/or any other properties of a conditioned space (e.g., a room of the conditioned space). Room sensor 132 and/or any other sensors may be positioned anywhere within the conditioned space, the HVAC system 100, and/or the surrounding environment.

The one or more liquid line isolation valves 134 are coupled to the working fluid conduit 102. The liquid line isolation valve 134 may be in signal communication with the controller 146 (e.g., via wired and/or wireless connection). In some embodiments, the liquid line isolation valve 134 may be a solenoid valve or any other suitable valve for reducing pressure loss from the working fluid. The liquid line isolation valve 134 may be in communication with the controller 146 (e.g., via wired and/or wireless communication) to receive control signals for opening and/or closing associated valves and/or to provide flow measurement signals corresponding to the rate of working fluid flow through the working fluid conduit 102. In some embodiments, multiple liquid line isolation valves 134 may be implemented to provide more robust control of the working fluid flow. In some embodiments, one liquid line isolation valve 134 may be implemented. In some cases where some refrigerant leakage may occur due to the inherent imperfections in the valve's seal, a single liquid line isolation valve 134 may not be sufficient to achieve zero flow of the working fluid. In such cases, one or more additional liquid line isolation valves 134 may be used to further reduce the leakage rate. The liquid line isolation valve 134 may be placed at any location along the liquid line that extends between the outdoor coil 108 and the indoor coil 116. In some examples, the liquid line isolation valve 134 may be placed within an outdoor section of the HVAC system 100. In some examples, the liquid line isolation valve 134 may be placed within an indoor section of the HVAC system 100. The liquid line isolation valve 134 is downstream of the outdoor coil 108 and is configured to remove pressure from the working fluid. In this way, the working fluid is delivered to the indoor coil 116.

The one or more vapor line isolation valves 135 are coupled to the working fluid conduit 102. The vapor line isolation valve 135 may be in signal communication with the controller 146 (e.g., via wired and/or wireless connection). In some embodiments, the vapor line isolation valve 135 may be a solenoid valve, a check valve, or any other suitable type of valve. For example, the vapor line isolation valve 135 may be a check valve for A/C units to allow the flow of the working fluid in one direction (e.g., from the indoor coil 116 towards the compressor 106). In some embodiments, for HVAC systems 100 that operate in cooling mode only (e.g., configured to provide cooling air conditioning), the vapor line isolation valve 135 may be a solenoid valve or a check valve. In some embodiments, the vapor line isolation valve 135 may be a discharge check valve located in the refrigerant line that connects the compressor 106 to the outdoor coil 108. In some embodiments, the discharge check valve may be internal to the compressor 106. In some embodiments, for HVAC systems 100 that are configured to operate in both cooling mode and heating mode (e.g., configured to provide both cooling and heating air conditioning), the vapor line isolation valve 135 may be a solenoid valve, optionally, arranged/connected in parallel with the pressure relief valve 136 (in case of a pressure build up inside the indoor coil 116).

In some embodiments, multiple vapor line isolation valves 135 may be implemented to provide more robust control of the working fluid flow. In some embodiments, one vapor line isolation valve 135 may be implemented. In some cases where some refrigerant leakage may occur due to the inherent imperfections in the valve's seal, a single vapor line isolation valve 135 may not be sufficient to achieve zero flow of the working fluid. In such cases, one or more additional vapor line isolation valves 135 may be used to further reduce the leakage rate. The vapor line isolation valve 135 may be placed at any location along the vapor line that extends between the compressor 106 and the indoor coil 116. In some examples, the vapor line isolation valve 135 may be placed within an outdoor section of the HVAC system 100. In some examples, the vapor line isolation valve 135 may be placed within an indoor section of the HVAC system 100.

The pressure relief valve 136 may be a check valve to allow flow of the working fluid in one direction as shown by the arrow in the pressure relief valve 136 in FIG. 1. The pressure relief valve 136 may be in parallel with the vapor line isolation valve 135. The pressure relief valve 136 may be passive, meaning that it does not require a control signal to activate. For example, during the pump down operation after a cooling cycle, the pressure relief valve 136 allows excess refrigerant pressure to dissipate and flow out of the indoor coil 116 in case it builds up in the indoor coil 116. The passive pressure relief valve 136 facilitates that any refrigerant pressure increase due to the isolation of refrigerant in the indoor coil 116 is reduced without requiring active control signals, e.g., from the controller 146. In some embodiments, the pressure relief valve 136 may be in use after the pump down cycle is completed after a heating cycle because it allows any excess refrigerant pressure to be released from the indoor coil 116 to reduce pressure buildup in the indoor coil 116 when the refrigerant is isolated and the HVAC system 100 switches from heating mode to cooling mode.

The thermostat 137 may be located within the conditioned space (e.g., a room or building) serviced by the HVAC system 100. In some embodiments, the controller 146 may be separate from or integrated within the thermostat 137. The thermostat 137 is configured to allow a user to input a desired temperature or baseline setpoint temperature for the conditioned space. In some embodiments, the thermostat 137 includes a user interface 138 and display 140 for displaying information related to the operation and/or status of the HVAC system 100. For example, the user interface 138 may communicate with the display 140 to show operational, diagnostic, and/or status messages and provide a visual interface that allows at least one of an installer, a user, a support entity, and a service provider to perform actions with respect to the HVAC system 100. For example, the user interface 138 may communicate with the display 140 to show messages related to the status and/or operation of the HVAC system 100.

The pressure sensor 142 may include a pressure sensor circuit. The pressure sensor 142 is in signal communication with the controller 146 (e.g., via wired and/or wireless connection). The pressure sensor 142 is positioned in or adjacent to the duct system 122 or the indoor coil 116. The pressure sensor 142 is configured to measure at least one gas property value of the airflow 118 in the duct system 122. For example, the pressure sensor 142 may be configured to measure the pressure of the refrigerant within the indoor coil 116 or the duct system 122. This measurement may be used to determine if the refrigerant charge 154 has increased to a level more than the threshold value 158. In response to determining that the refrigerant charge 154 has increased to a level more than the threshold value 158, the controller 146 may trigger/initiate the pump down cycle by executing the pump down instructions 151 via the processor 148.

In some cases, the increase in the refrigerant charge 154 within the duct system 122 or the indoor coil 116 may be due to a refrigerant leakage from the indoor coil 116 or fuel leaked from the heating element 117, etc. The low-pressure sensor 142 is configured to measure a change in at least one gas property value of the airflow 118 in the duct system 122 to determine a concentration of gas based on the change in the gas property values, such as pressure, temperature, or specific gas concentration. In some embodiments, the low-pressure sensor 142 may be a capacitive pressure sensor, and a resonant pressure sensor, among others. The capacitive pressure sensor may include a capacitor. The changes in refrigerant pressure may cause the capacitance between the plates of the capacitor to change. This change in the capacitance may be measured and converted into a pressure reading according to a capacitance-pressure table (e.g., in the form of a calibration curve 166) associated with the capacitive pressure sensor. The calibration curve 166 may be constructed and stored in the controller 146 by measuring the capacitance of the capacitive pressure sensor for known concentrations of refrigerants. In some embodiments, the capacitive pressure sensor takes a baseline measurement when refrigerant charge 154 is less than the threshold value 158 and/r no gas leak is present in the airflow 118. The controller 146 stores a reference capacitance measurement for air. The change in the capacitance measurement may be determined by the difference between the measured capacitance value and the baseline measurement, or the difference between the measured capacitance value and the reference capacitance measurement.

The resonant pressure sensor may include a resonating element, such as a vibrating wire or silicon micro resonator. The changes in refrigerant pressure cause variations in the resonance frequency of the resonating element. In response, this change may be measured and converted into a pressure reading according to a resonance frequency-pressure table (e.g., in the form of a calibration curve 166) associated with the resonant pressure sensor. The calibration curve 166 may be constructed and stored in the controller 146 by measuring the resonance of the resonant pressure sensor for known concentrations of refrigerants. In some embodiments, the resonant pressure sensor takes a baseline measurement when refrigerant charge 154 is less than the threshold value 158 and/or no gas leak is present in the airflow 118. The controller 146 stores a reference resonance frequency measurement for air. The change in the resonance frequency measurement may be determined by the difference between the measured resonance frequency value and the baseline measurement, or the difference between the measured resonance frequency value and the reference capacitance measurement.

The pressure switch 144 may include a pressure switch circuit. The pressure switch 114 is in signal communication with the controller 146 (e.g., via wired and/or wireless connection). The pressure switch 144 may be an electromechanical switch circuit that is configured to activate or deactivate based on the pressure of the refrigerant within the indoor section of the HVAC system 100 (e.g., within the indoor coil 116 and/or duct system 122). The pressure switch 144 is positioned in or adjacent to the duct system 122 and is in signal communication with the pressure sensor 142 (e.g., via wired and/or wireless connection). The pressure sensor 142 sends the pressure measurements to the pressure switch 144. The pressure switch 144 sends a signal 168 to the controller 146, where the signal 168 may include the refrigerant pressure measurement from within the indoor section of the HVAC system 100. In response, the controller 146 may determine whether the refrigerant charge 154 is more than the threshold value 158 based on the received refrigerant pressure measurement. For example, if the refrigerant pressure exceeds a threshold pressure value (e.g., 150 pounds per square inch (psi), 200 psi, 250 psi, etc.), it may be determined that the refrigerant charge 154 is more than the threshold value 158 (e.g., 5 pounds, 6 pounds, 7 pounds, etc. of refrigerant). If it is determined that the pressure measurement is more than the threshold value 158, the controller 146 may perform the pump down cycle. The pump down cycle is described in greater detail in conjunction with the operational flow of FIG. 1 and method 200 of FIG. 2.

The controller 146 is communicatively coupled (e.g., via wired and/or wireless connection) to components in the HVAC system 100 and configured to control their operation. In some embodiments, controller 146 can be one or more controllers associated with one or more components of the HVAC system 100. The controller 146 includes a processor 148, memory 150, and an input/output (I/O) interface 152. The processor 148 comprises one or more processors operably coupled to the memory 150. The processor 148 is any electronic circuitry including, but not limited to, state machines, one or more central processing unit (CPU) chips, logic units, cores (e.g., a multi-core processor), field-programmable gate array (FPGAs), application-specific integrated circuits (ASICs), or digital signal processors (DSPs) that communicatively couples to memory 150 and controls the operation of HVAC system 100. The processor 148 may be a programmable logic device, a microcontroller, a microprocessor, or any suitable combination of the preceding. The processor 148 is communicatively coupled to and in signal communication with the memory 150. The one or more processors are configured to process data and may be implemented in hardware or software. For example, the processor 148 may be 8-bit, 16-bit, 32-bit, 64-bit or of any other suitable architecture. The processor 148 may include an arithmetic logic unit (ALU) for performing arithmetic and logic operations, processor registers that supply operands to the ALU and store the results of ALU operations, and a control unit that fetches instructions from memory 150 and executes them by directing the coordinated operations of the ALU, registers, and other components. The processor 148 may include other hardware and software that operates to process information, control the HVAC system 100, and perform any of the functions described herein. The processor 148 may be configured to execute software instructions to perform operations of the controller 146. For example, the processor 148 may be configured to execute the pump down instructions 151 to perform the pump down cycle as described herein. The processor 148 is not limited to a single processing device and may encompass multiple processing devices. The processor 148 may be configured to perform one or more operations of the controller 146 described in FIG. 1 and one or more operations of the method 200 described in FIG. 2.

The memory 150 may be a non-transitory computer-readable medium. The memory 150 includes one or more disks, tape drives, or solid-state drives, and may be used as an over-flow data storage device, to store programs when such programs are selected for execution, and to store instructions and data that are read during program execution. The memory 150 may be volatile or non-volatile and may comprise ROM, RAM, ternary content-addressable memory (TCAM), dynamic random-access memory (DRAM), and static random-access memory (SRAM). The memory 150 is operable to store any suitable set of instructions, logic, rules, and/or code for executing the functions described in this disclosure. For example, the memory 150 may store pump down instructions 151, refrigerant charges 154, pressure values 156, threshold valve 158, control signals 160*a-e*, time-based control algorithm 162, collaboration curves 166, signals 168 and/or other data, instructions, and operating parameters for components in the system 100.

The I/O interface 152 is configured to communicate data and signals with other devices. For example, the I/O interface 152 may be configured to communicate electrical signals with the other components of the HVAC systems 100. The I/O interface 152 may comprise ports and/or terminals for establishing signal communications between the controller 146 and other devices. The I/O interface 152 may be configured to enable wired and/or wireless communications. Connections between various components of the HVAC system 100 and between components of system 100 may be wired or wireless. For example, conventional cable and contacts may be used to couple the thermostat 137 to the controller 146 and various components of the HVAC system 100, including, the compressor 106, the heating element 117, the blower 128, the liquid line isolation valve 134, the vapor line isolation valve 135, the pressure relief valve 136, the pressure sensor 142, the pressure switch 144, and the room sensor 132. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer-readable medium, or encoded logic incorporated in hardware or otherwise stored (e.g., firmware) to couple components of the HVAC system 100 to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 146 to other components of the HVAC system 100.

Operational Flow for Mitigating Excess Refrigerant Charge

In some embodiments, the controller 146 may be configured to perform the pump down cycle to proactively reduce any potential excess refrigerant charge 154 within the indoor section of the HVAC system 100. The pump down cycle may be implemented by the processor 148 executing the pump down instructions 151. In some embodiments, the pump down cycle may be performed in response to various triggers or conditions. For example, the pump down cycle may be performed after (e.g., at the end of) a conditioning demand, where the conditioning demand may be a cooling demand or a heating demand. In another example, the pump down cycle may be performed during an off-cycle period when no conditioning demand is present or a conditioning demand was not recently performed. In some embodiments, the pump down cycle may be performed periodically during off-cycle periods, such as every five minutes, every ten minutes, etc. In another example, the pump down cycle may be performed in response to determining that the refrigerant charge 154 inside the indoor section (e.g., inside the indoor coil 116 and/or the duct system 122) has reached a predefined threshold, where the predefined threshold value 158 is defined to be less than the allowed regulatory threshold value as set by the safety standards. In another example, the pump down cycle may be performed on demand, e.g., in response to receiving an input on the thermostat 137, e.g., when a user provides the input to initiate the pump down cycle. In other examples, the pump down cycle may be performed in response to any suitable trigger, such as detecting a refrigerant leak within the indoor section of the HVAC system 100, among others.

During the pump down cycle, the controller 146 may transmit certain control signals 160*a-e* to various components of the HVAC system 100 to isolate the indoor section of the HVAC system 100 from the outdoor section of the HVAC system 100 to allow the refrigerant to flow out of the indoor coil 116 so that the refrigerant charge 154 within the indoor section remains less than the threshold value 158. In this process, the controller 146 may transmit the control signal 160*a* to the compressor 106 to turn on or stay turned on to transfer at least a portion of the refrigerant from the indoor heat exchanger (e.g., indoor coil 116) to the outdoor heat exchanger (e.g., outdoor coil 108) to reduce the refrigerant charge 154 in the indoor section of the HVAC system 100.

In some embodiments, the pump down cycle may be performed at the end of the conditioning demand. In such embodiments, the compressor 106 may stay turned on in response to receiving the control signal 160*a* from the compressor 106. In some embodiments, the pump down cycle may be performed during an off-cycle period. In such embodiments, the compressor 106 may be turned on in response to receiving the control signal 160*a* from the compressor 106. The controller 146 may transmit the control signal 160*b* to the vapor line isolation valve 135, where the control signal 160*b* causes the vapor line isolation valve 135 to open. This allows the flow of the refrigerant from the indoor coil 116 to the compressor 106. The controller 164 may transmit the control signal 160*c* to the liquid line isolation valve 134, where the control signal 160*c* causes the liquid line isolation valve 134 to close. This blocks the flow of refrigerant from the outdoor coil 108 into the indoor coil 116.

In this way, the controller 146 causes the refrigerant to be at least partially removed from the indoor coil 116, and the refrigerant charge 154 within the indoor section of the HVAC system 100 is maintained at less than the threshold value 158. In some embodiments, the controller 146 may transmit the control signals 160*a-e* to the compressor 106, the vapor line isolation valve 135, and the liquid line isolation valve 134 in any order.

The compressor 106 may stay turned on, the vapor line isolation valve 135 may stay open, and the liquid line valve 134 may stay closed for a period of time until it is determined that the refrigerant charge 154 within the indoor section of the HVAC system 100 is less than the threshold value 158. The controller 146 may monitor the refrigerant charge 154 within the indoor section of the HVAC system 100 based on the signals 168 received from the pressure switch 144, similar to that described above. In response, the controller 146 may determine whether the refrigerant charge 154 within the indoor section of the HVAC system 100 has been reduced to be less than the threshold value 158. If it is determined that the refrigerant charge 154 within the indoor section of the HVAC system 100 has reduced to be less than the threshold value 158, the controller 146 may transmit a control signal 160*d* to the compressor 106, where the control signal 160*d* may cause the compressor 106 to turn off. Further, if it is determined that the refrigerant charge 154 within the indoor section of the HVAC system 100 has reduced to be less than the threshold value 158, the controller 146 may transmit the control signal 160*e* to the vapor line isolation valve 135, where the control signal 160*e* causes the vapor line isolation valve 135 to close. The controller 146 may transmit the control signal 160*e* to the vapor line isolation valve 135 before or after the compressor 106 is turned off. Otherwise, if it is determined that the refrigerant charge 154 within the indoor section of the HVAC system 100 is more than the threshold value 158, the controller 146 may continue the pump down cycle until it is determined that the refrigerant charge 154 within the indoor section of the HVAC system 100 has reduced to be less than the threshold value 158.

In some embodiments, the controller 146 may determine the refrigerant charge 154 inside with indoor coil 116 by the following methods. In some embodiments, the controller 146 may implement a low-pressure sensor 142 to monitor the pressure of the refrigerant inside the indoor coil 116. In this method, the low-pressure sensor 142 provides pressure readings, which the controller 146 may use to infer the refrigerant charge 154 based on predefined calibration curves 166 and reference values, similar to that described above.

In some embodiments, the controller 146 may implement a time-based control algorithm 162 to estimate the refrigerant charge 154 inside the indoor coil 116 based on the amount of time that the compressor 106 has been turned on. The time-based control algorithm 162 may be executed by the processor 148. In this method, the controller 146 may determine the amount of accumulated refrigerant charge 154 by considering the duration that compressor 106 has been active and the characteristics of the compressor 106, such as capacity and the flow rate that which the compressor 106 moves the refrigerant through the HVAC system 100.

In some embodiments, the controller 146 may implement a pressure switch 144 that is preset to a specific pressure value associated with the threshold value 158 for the refrigerant charge 154. In this method, the controller 146 may receive signals 168 from the pressure switch 144 when the pressure of the refrigerant inside the indoor coil 116 reaches a predefined threshold value 158. The controller 146 may determine whether to initiate the pump down cycle based on the received signals 168, similar to that described above.

In some cases, the pump down cycle may be performed after (e.g., at the end of) a cooling cycle. In such cases, the pump down cycle may be performed similar to that described above. In some cases, the pump down cycle may be performed after a heating cycle. In such cases, the controller 146 may switch the HVAC system 100's mode from heating mode to cooling mode before initiating the pump down cycle. In the pump down cycle after the heating cycle, the pressure relief valve 136 allows for refrigerant pressure to be reduced by allowing the refrigerant to flow via the pressure relief valve 136. During the heating cycle, the direction of the flow of the refrigerant in the vapor line is towards the indoor coil 116. Thus, for performing the pump down cycle at the end of the heating cycle, the controller 146 may switch the HVAC system 100's mode from heating mode to cooling mode, and the pressure relief valve 136 may be implemented in parallel to the vapor line isolation valve 135 to allow the release of the refrigerant charge 154 from the indoor coil 116.

Method for Mitigating Excess Refrigerant Charge

FIG. 2 illustrates a flowchart of an example method 200 of operating the system 100 of FIG. 1. The method 200 may be performed by the controller 164 (see FIG. 1) when one or more processors (e.g., processor 148 of FIG. 1) execute software instructions (e.g., pump down instructions 151) stored in one or more memories (e.g., memory 150 of FIG. 1). The method 200 may include operations 202-212.

At operation 202, the controller 146 transmits a first control signal 160*a* to the compressor 106, and the first control signal 160*a* causes the compressor 106 to turn on or stay turned on, similar to that described in FIG. 1.

At operation 204, the controller 146 transmits a second control signal 160*b* to the vapor line isolation valve 135, the second control signal 160*b* causes the vapor line isolation valve 135 to open, similar to that described in FIG. 1.

At operation 206, the controller 146 transmits a third control signal 160*c* to the liquid line isolation valve 136, the third control signal 160*c* causes the liquid line isolation valve 136 to close, similar to that described in FIG. 1.

At operation 208, the controller 146 determines whether the refrigerant charge 154 inside the indoor section of the HVAC system 100 is less than a threshold value 158. The indoor section of the HVAC system 100 may include any components of the HVAC system 100 that are indoors, such as the indoor coil 116, at least a part of the duct system 122. If it is determined that the refrigerant charge 154 inside the indoor section of the HVAC system 100 is less than the threshold value 158, the method 200 proceeds to operation 210. Otherwise, the method 200 remains at operation 208 and the controller 146 may continue to monitor the refrigerant charge 154 inside the indoor section of the HVAC system 100 using the pressure switch 144, pressure sensor 142, refrigerant charge 154 detection devices, among others, similar to that described in FIG. 1.

At operation 210, the controller 146 sends a fourth control signal 160*d* to the compressor 106, the fourth control signal 160*d* causes the compressor 106 to turn off.

At operation 214, the controller sends a fifth control signal 160*e* to the vapor line isolation valve 135, where the fifth control signal 160*e* causes the vapor line isolation valve 135 to close. In some embodiments, the control signals 160 may be sent to respective components in any suitable order, in parallel, or in series.

Modifications, additions, or omissions may be made to the systems and methods described herein without departing from the scope of the disclosure. The systems and methods may include more, fewer, or other steps. Additionally, steps may be performed in any suitable order, in parallel, or in series.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A heating, ventilation, and air conditioning (HVAC) system, the HVAC system comprising:

a vapor line isolation valve located in a vapor line of the HVAC system;

a liquid line isolation valve located in a liquid line of the HVAC system;

a compressor configured to move refrigerant between an indoor heat exchanger and an outdoor heat exchanger;

a low-pressure sensor configured to:

measure a pressure of a refrigerant within the indoor heat exchanger; and communicate the measured pressure of the refrigerant to an electromechanical pressure switch;

the electromechanical pressure switch is configured to activate based at least in part upon the measured pressure of the refrigerant within the indoor heat exchanger;

a controller communicatively coupled to the vapor line isolation valve, the liquid line isolation valve, the electromechanical pressure switch, and the compressor, comprising a processor configured to:

receive, from the electromechanical pressure switch, a signal that indicates the measured pressure of the refrigerant within the indoor heat exchanger;

determine, based at least in part upon the received signal, that a refrigerant charge has increased more than the threshold value;

in response to determining that the refrigerant charge has increased more than the threshold value:

when in a heating cycle, switch the HVAC system from the heating cycle to a cooling cycle; and perform a pump down cycle comprising:

transmit, to the compressor, a first signal that causes the compressor to be turned on or stay turned on to transfer at least a portion of the refrigerant from the indoor heat exchanger to the outdoor heat exchanger to reduce the refrigerant charge in an indoor section of the HVAC system;

transmit, to the vapor line isolation valve, a second signal that causes the vapor line isolation valve to open;

transmit, to the liquid line isolation valve, a third signal that causes the liquid line isolation valve to close;

determine that the refrigerant charge in the indoor section of the HVAC system has decreased to be less than the threshold value; and in response to determining that the refrigerant charge in the indoor section of the HVAC system has decreased to be less than the threshold value:

turn off the compressor; and close the vapor line isolation valve.

2. The HVAC system of claim 1, wherein:

the pump down cycle is performed after a conditioning demand; and the conditioning demand is a cooling demand or a heating demand.

3. The HVAC system of claim 1, wherein the pump down cycle is performed during an off-cycle period when no conditioning demand is present.

4. The HVAC system of claim 1, wherein:

the processor is further configured to determine the refrigerant charge inside an indoor coil associated with the HVAC system; and the pump down cycle is performed when the refrigerant charge inside the indoor coil is determined to be more than the threshold value.

5. The HVAC system of claim 4, wherein determining the refrigerant charge inside the indoor coil comprises estimating, by a time-based control algorithm, the refrigerant charge inside the indoor coil based at least in part upon an amount of time that the compressor has been turned on.

6. The HVAC system of claim 1, wherein the vapor line isolation valve is positioned within the indoor section of the HVAC system.

7. The HVAC system of claim 1, wherein the vapor line isolation valve is positioned within an outdoor section of the HVAC system.

8. A method of operating heating, ventilation, and air conditioning (HVAC) system, the method comprising:

receiving, from an electromechanical pressure switch, a signal that indicates a measured pressure of the refrigerant within an indoor heat exchanger, wherein:

the pressure of the refrigerant within the indoor heat exchanger is measured by a low-pressure sensor;

the measured pressure is communicated to the electromechanical pressure switch; and the electromechanical pressure switch is activated based at least in part upon the measured pressure of the refrigerant within the indoor heat exchanger;

determining, based at least in part upon the received signal, that a refrigerant charge has increased more than a threshold value; and in response to determining that the refrigerant charge has increased more than the threshold value:

when in a heating cycle, switching the HVAC system from the heating cycle to a cooling cycle; and performing a pump down cycle comprising:

transmitting, to a compressor, a first signal that causes the compressor to be turned on or stay turned on to transfer at least a portion of a refrigerant from the indoor heat exchanger to an outdoor heat exchanger to reduce the refrigerant charge in an indoor section of the HVAC system;

transmitting, to a vapor line isolation valve, a second signal that causes the vapor line isolation valve to open;

transmitting, to a liquid line isolation valve, a third signal that causes the liquid line isolation valve to close;

determining that the refrigerant charge in the indoor section of the HVAC system has decreased to be less than the threshold value; and in response to determining that the refrigerant charge in the indoor section of the HVAC system has decreased to be less than the threshold value:

turning off the compressor; and closing the vapor line isolation valve.

9. The method of claim 8, wherein:

the pump down cycle is performed after a conditioning demand; and the conditioning demand is a cooling demand or a heating demand.

10. The method of claim 8, wherein the pump down cycle is performed during an off-cycle period when no conditioning demand is present.

11. The method of claim 8, wherein:

the method further comprises determining the refrigerant charge inside an indoor coil associated with the HVAC system; and the pump down cycle is performed when the refrigerant charge inside the indoor coil is determined to be more than the threshold value.

12. The method of claim 11, wherein determining the refrigerant charge inside the indoor coil comprises estimating, by a time-based control algorithm, the refrigerant charge inside the indoor coil based at least in part upon an amount of time that the compressor has been turned on.

13. The method of claim 8, wherein the vapor line isolation valve is positioned within the indoor section of the HVAC system.

14. The method of claim 8, wherein the vapor line isolation valve is positioned within an outdoor section of the HVAC system.

15. A controller of a heating, ventilation, and air conditioning (HVAC) system, the controller comprising:

a memory configured to store pump down instruction for performing a pump down cycle; and a processor communicatively coupled with the memory, and configured to:

receive, from an electromechanical pressure switch, a signal that indicates a measured pressure of refrigerant within an indoor heat exchanger;

determine, based at least in part upon the received signal, that a refrigerant charge has increased more than a threshold value, wherein:

the pressure of the refrigerant within the indoor heat exchanger is measured by a low-pressure sensor;

the measured pressure is communicated to the electromechanical pressure switch; and the electromechanical pressure switch is activated based at least in part upon the measured pressure of the refrigerant within the indoor heat exchanger;

in response to determining that the refrigerant charge has increased more than the threshold value:

when in a heating cycle, switch the HVAC system from the heating cycle to a cooling cycle;

transmit, to a compressor, a first signal that causes the compressor to be turned on or stay turned on to transfer at least a portion of a refrigerant from the indoor heat exchanger to an outdoor heat exchanger to reduce the refrigerant charge in an indoor section of the HVAC system;

transmit, to a vapor line isolation valve, a second signal that causes the vapor line isolation valve to open;

transmit, to a liquid line isolation valve, a third signal that causes the liquid line isolation valve to close;

determine that the refrigerant charge in the indoor section of the HVAC system has decreased to be less than the threshold value; and in response to determining that the refrigerant charge in the indoor section of the HVAC system has decreased to be less than the threshold value:

turn off the compressor; and close the vapor line isolation valve.

16. The controller of claim 15, wherein:

the pump down cycle is performed after a conditioning demand; and the conditioning demand is a cooling demand or a heating demand.

17. The controller of claim 15, wherein the pump down cycle is performed during an off-cycle period when no conditioning demand is present.

18. The controller of claim 15, wherein the HVAC system is configured to operate in a cooling mode, and the vapor line isolation valve comprises a solenoid valve or a check valve.

19. The controller of claim 15, wherein the HVAC system is configured to operate in both a cooling mode and a heating mode, and the vapor line isolation valve comprises a solenoid valve arranged in parallel with a pressure relief valve.

20. The controller of claim 15, wherein the electromechanical pressure switch is preset to a specific pressure value associated with the threshold value for the refrigerant charge.

* * * * *